US008662946B2

(12) United States Patent
Gadler

(10) Patent No.: US 8,662,946 B2
(45) Date of Patent: Mar. 4, 2014

(54) BODY SURFING SUIT

(75) Inventor: Nicholas Noel Gadler, El Cajon, CA (US)

(73) Assignee: WaveWrecker, LLC, El Cajon, CA (US)

( * ) Notice: Subject to any disclaimer, the term of this patent is extended or adjusted under 35 U.S.C. 154(b) by 350 days.

(21) Appl. No.: 12/967,945

(22) Filed: Dec. 14, 2010

(65) Prior Publication Data

US 2011/0151733 A1 Jun. 23, 2011

Related U.S. Application Data

(60) Provisional application No. 61/288,773, filed on Dec. 21, 2009.

(51) Int. Cl.
*B63B 35/73* (2006.01)

(52) U.S. Cl.
USPC ..... 441/55; 441/59; 441/60; 441/61

(58) Field of Classification Search
USPC ..... 441/55–65, 102–105; 2/2.15–2.17, 67
See application file for complete search history.

(56) References Cited

U.S. PATENT DOCUMENTS

| | | | | | |
|---|---|---|---|---|---|
| 3,286,287 | A | * | 11/1966 | Martin | 441/57 |
| 3,803,652 | A | | 4/1974 | Uyehara | |
| D245,532 | S | * | 8/1977 | Taylor | D21/805 |
| 4,397,636 | A | | 8/1983 | Ganshaw | |
| 4,710,978 | A | * | 12/1987 | Pankopf | 2/2.16 |
| 5,013,271 | A | * | 5/1991 | Bartlett | 441/65 |
| 5,015,208 | A | | 5/1991 | Fox et al. | |
| 5,033,116 | A | * | 7/1991 | Itagaki et al. | 2/67 |
| 5,052,053 | A | * | 10/1991 | Peart et al. | 2/2.16 |
| 5,106,331 | A | * | 4/1992 | Lizarazu | 441/55 |
| 5,173,068 | A | | 12/1992 | Dunn et al. | |
| 5,183,424 | A | * | 2/1993 | Field | 441/64 |
| 6,213,831 | B1 | * | 4/2001 | Smith | 441/65 |
| RE37,533 | E | | 1/2002 | Beige et al. | |
| 6,446,264 | B2 | | 9/2002 | Fairhurst et al. | |
| 2008/0020660 | A1 | | 1/2008 | Barney | |

* cited by examiner

*Primary Examiner* — Edwin Swinehart
(74) *Attorney, Agent, or Firm* — Procopio, Cory, Hargreaves & Savitch LLP

(57) ABSTRACT

Apparatus and methods for body surfing which provide the body surfer a means to stabilize his ride and control his direction/position on a wave are described herein. According to one aspect, a body surfing apparatus includes a body suit having a torso and legs; a plurality of fins located on the torso; and one or more fins located laterally on the legs. The fins are preferably attached to the body suit via an adhesive or mechanical means and the fins and suit are preferably covered with a buoyant layer, the buoyant layer having a minimum thickness of 1 mm.

30 Claims, 4 Drawing Sheets

BODY SURFING SUIT

RELATED APPLICATIONS INFORMATION

This application claims priority under 35 U.S.C. 119(e) to U.S. Provisional Patent Application Ser. No. 61/288,773, filed Dec. 21, 2009, and entitled "Body Surfing Suit," which is incorporated herein by reference in its entirety as if set forth in full.

FIELD OF THE INVENTION

The present invention relates, in general, to body surfing, and more particularly to a body surfing suit. More particularly, the present invention relates to a buoyant body suit that also improves velocity and directional control in the water.

BACKGROUND OF THE INVENTION

Body surfing is a way to enjoy the thrill of riding a wave. Body surfers, generally, simply extend their bodies horizontally, projecting their arms forward and in line with their body while allowing a breaking wave to drive them shoreward with the surf. To the body surfer, it is important to be able to ride waves of varied sizes, to enjoy a stable ride and to be able to control direction and position on a wave face. Since a body surfer rarely uses any equipment other than swim fins, it is quite difficult for a body surfer to adequately control the stability of his ride and control his direction and position on a wave face.

For a body surfing suit to work in real life, bending is key (to allow for swimming), and buoyancy in the correct location (s) is also key. It is preferable to have a buoyancy gradient that is greatest (e.g., most buoyant) at the surfer's head and tapers down toward the feet to ensure that the surfer does not plow and tumble face first.

A few body surfing suits can be found in the prior art. For example, U.S. Pat. No. 5,106,331 to Lizarazu discloses a body surfing apparatus having a garment with a rigid outer shell attached to the torso portion of the garment and an inner buoyant unit underneath the torso portion of the garment. The rigid outer shell and inner buoyant unit make up a laminated multi-layered abdominal-chest plate. The shape of the abdominal-chest plate is contoured to cover the abdomen and extend upward into the central portion of the chest. This has two major problems: (1) the chest plate does not allow adequate forward bending because the rigidity of the laminated structure is not anatomically designed to allow full bending where the body actually bends (namely, the ribcage needs to be separate from the abdomen or it severely limits bending which one needs to swim properly) and (2) the suit puts the buoyant material in the wrong place, e.g., front center of the body, which results in plowing.

Additionally, the Lizarazu body surfing suit includes a number of fins located on the rigid outer shell and on the arms and legs of the suit. The arm fins are positioned on the upper arm region, are shaped incorrectly to be functional, and the lack of smooth edge detail causes a lot of drag. The arm fins do not likely provide buoyancy, but are rather present for stability. The legs fins suffer from similar problems as the arm fins and are present only for stability.

U.S. Pat. No. 5,013,271 to Bartlett discloses a body surfing suit having buoyant material placed on the chest and in various channels located on the legs of the suit. The Bartlett body surfing suit suffers from the following problems: (1) The buoyant material is incorrectly placed anteriorly and the main component includes coverage of the chest and abdomen in one piece; this makes the suit too rigid to allow adequate bending/tucking forward which is almost a requirement when maneuvering in the water to consistently catch waves. (2) In the upper chest and back region, the buoyant material is positioned both on the front and back of the suit in pad-like structures, but is not contoured anatomically and offers little benefit beyond adding some buoyancy. The back pads are simply buoyant areas without defined, streamlined 3-D contours. (3) The upper pointed regions of the chest piece extend out near the shoulder. These points impede anterior movement of the arm during the swimming stroke. (4) The suit does not have fins to aid in stability.

The present invention seeks to overcome these limitations by providing the body surfer a means to stabilize his ride and control his direction/position on a wave.

SUMMARY

Apparatus and methods for body surfing which provide the body surfer a means to stabilize his ride and control his direction/position on a wave are described herein.

According to one aspect, a body surfing apparatus includes a body suit having a torso and legs; a plurality of fins located on the torso; and one or more fins located laterally on the legs. The fins are preferably attached to the body suit via an adhesive or mechanical means and the fins and suit are preferably covered with a buoyant layer, the buoyant layer having a minimum thickness of 2 mm.

According to another aspect, a body surfing apparatus includes a body suit having a torso, arms and legs; a plurality of fins located on the torso; and one or more fins located laterally on the legs. The fins are preferably attached to the suit via adhesive or mechanical means and the suit and fins are preferably covered with a buoyant layer, the buoyant layer having a thickness of about 5-100 mm on the torso and a thickness of about 1-75 mm on the legs.

BRIEF DESCRIPTION OF THE DRAWINGS

The accompanying drawings, which are incorporated in and constitute a part of the specification, illustrate embodiments of the invention, and together with the description, serve to explain the objects, advantages, and principles of the invention. In the drawings.

DETAILED DESCRIPTION OF PREFERRED EMBODIMENTS

After reading this description it will become apparent to one skilled in the art how to implement the invention in various alternative embodiments and alternative applications. However, all the various embodiments of the present invention will be described herein, it is understood that these embodiments are presented by way of an example only, and not limitation. As such, this detailed description of various alternative embodiments should not be construed to limit the scope or breadth of the present invention as set forth below.

Figure 1:
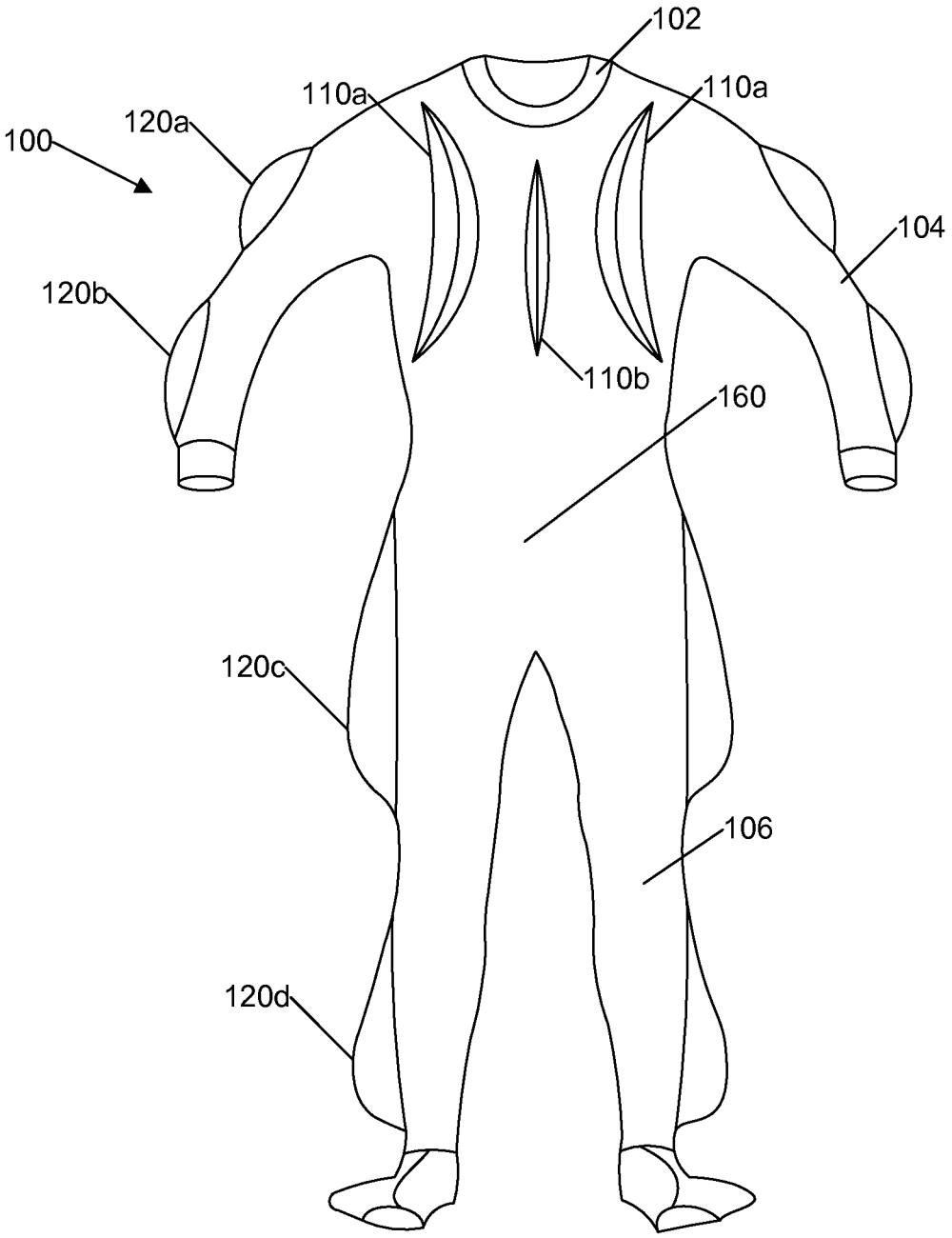
FIG. 1 is a front view of a body surfing suit in accordance with an embodiment of the invention.
Figure 2:
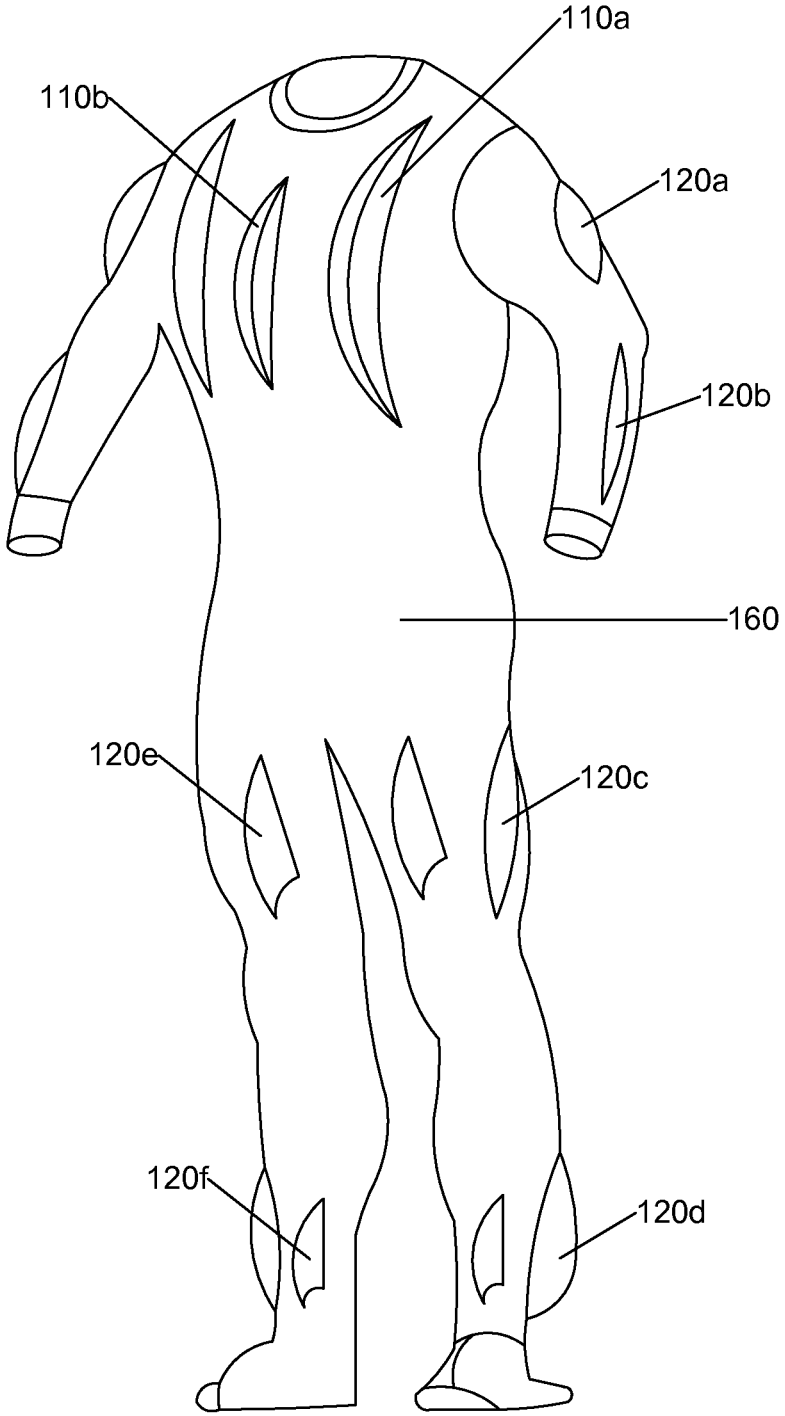
FIG. 2 is a side view of a body surfing suit in accordance with an embodiment of the invention.
Figure 3:
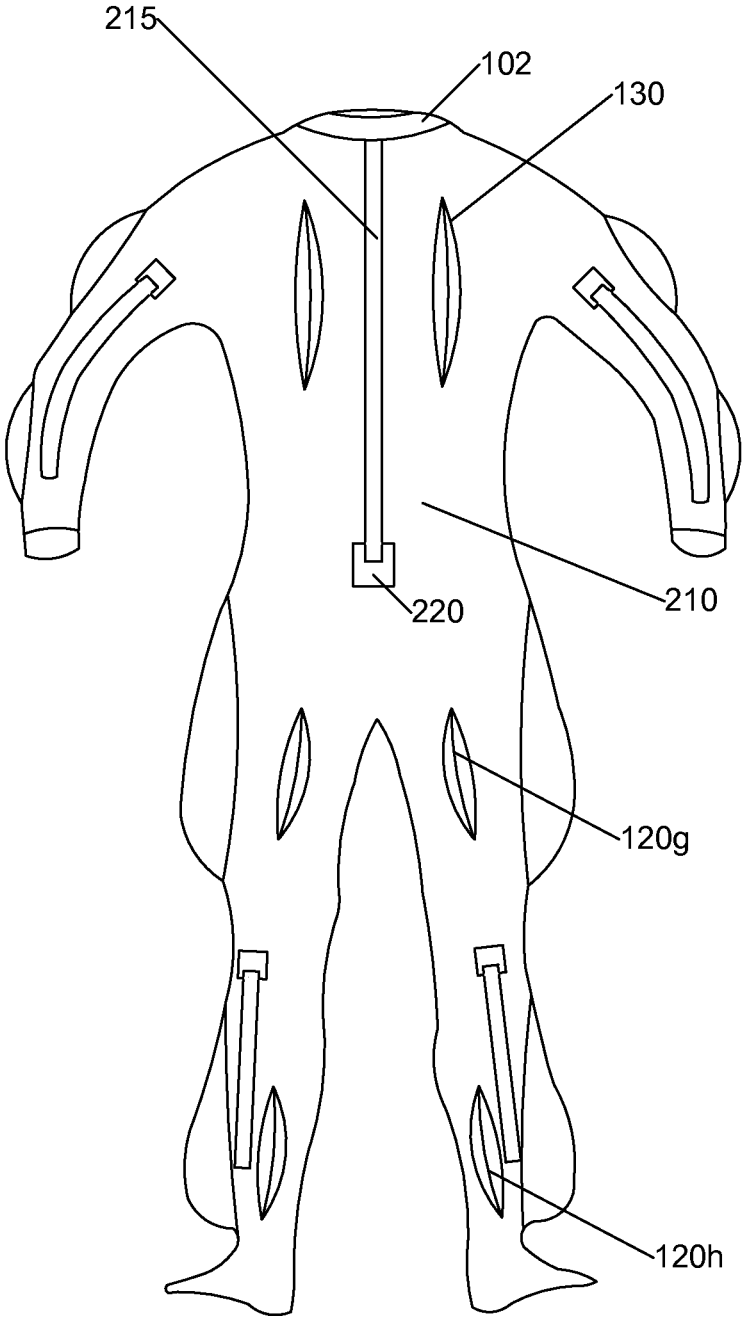
FIG. 3 is a rear view of a body surfing suit in accordance with an embodiment of the invention.

With reference to FIG. 1, an embodiment of the body surfing suit 100 is shown in a front view. Body surfing suit 100 includes a body 160 having a collar 102, a pair of sleeves 104, and a pair of legs 106 that extend below the knees. Sleeves 104 and/or legs 106 may be short or long. In some embodiments, sleeves 104 may not be necessary. However, when used with fasteners (discussed below), sleeves 104 are preferably long, as shown in FIGS. 1-3.

Body 160 of body surfing suit 100 is preferably constructed from neoprene or other lightweight, stretchable, water, chemical and UV resistant material. Neoprene, also known as polychloroprene, is part of a family known as synthetic rubbers or plastics. For example, this underlay/undergarment material 160 of suit 100 may be fabricated from neoprene in various thicknesses. A thicker neoprene suit provides more buoyancy and allows a surfer to body surf in colder waters (e.g., East Coast) since neoprene keeps the body temperature elevated. In some embodiments, an off-the-shelf wetsuit may be used for body surfing suit 100.

For example, for those applications which exposure properties to temperature differences, such as those associated with diving, the neoprene may be manufactured by foaming the neoprene plastic with an inert nitrogen gas. When placed in the presence of nitrogen gas being foamed into the neoprene material, tiny enclosed bubbles create voids in the material which reduce the surface area covered. These bubbles also help reduce the density of the material, allowing it to be much more buoyant. The buoyancy factor is quite helpful when used in wakeboarding, surfing and snorkeling applications.

Body surfing suit 100 also includes a plurality of chest rails or chest fins 110, which extend approximately from the interior border of the neck to the bottom of the rib cage of the surfer. In some embodiments, chest fins 110 are thicker at the base (proximate to body 160) and taper upward to a rounded, e.g., dolphin dorsal-like fin, point at the top or edge. Chest fins 110 preferably aid in gripping the side of a wave, provide directional stability as well as prevent yaw and roll.

As shown in FIGS. 1 and 2, there are three chest fins—two laterals fins 110*a* and one center fin 110*b*. In some embodiments, the lateral fins 110*a* are about 2-170 millimeters wide at the base and taper up to an about a 1-40 millimeter wide rounded point at the top or edge. In a preferred embodiment, lateral fins 110*a* are about 40 millimeters wide at the base and taper up to an about a 15 millimeter wide rounded point at the top or edge. In some embodiments, lateral fins 110*a* are about 10-150 millimeters tall, e.g., from base to edge. In a preferred embodiment, lateral fins 110*a* are about 50 millimeters tall.

In some embodiments, center chest fin 110*b* is about 2-150 millimeters wide at the base and tapers up to an about 1-40 millimeter wide rounded point at the top or edge. In a preferred embodiment, center fin 110*b* is about 45 millimeters wide at the base and tapers up to an about 15 millimeter wide rounded point at the top or edge. In some embodiments, center fin 110*b* is about 10-150 millimeters tall. In a preferred embodiment, center fin 110*b* is about 40 millimeters tall.

Body surfing suit 100 also includes a plurality of fins or skeggs 120 located on at least the sleeves 104 and/or legs 106 of body 160. As shown in FIGS. 1 and 2, one or more fins 120 may be located on each sleeve 104 of body 160, e.g., a fin 120*a* is located laterally on the upper arm region and a fin 120*b* is located laterally on the lower arm region. For example, in some embodiments, the lateral fins 120*a* are about 2-120 millimeters wide at the base and taper up to an about a 1-40 millimeter wide rounded point at the top or edge. In a preferred embodiment, lateral fins 120*a* are about 30 millimeters wide at the base and taper up to an about a 5 millimeter wide rounded point at the top or edge. In some embodiments, lateral fins 120*a* are about 10-100 millimeters tall, e.g., from base to edge. In a preferred embodiment, lateral fins 120*a* are about 50 millimeters tall.

In some embodiments, the lower arm fins 120*b* are about 2-100 millimeters wide at the base and taper up to about a 1-40 millimeter wide rounded point at the top or edge. Preferably, the lower arm fins 120*b* are centered laterally at the mid-portion of the forearm, between the wrist and the elbow, front to back. In a preferred embodiment, the lower arm fins 120*b* are about 30 millimeters wide at the base and taper up to about a 5 millimeter wide rounded point at the top or edge. In some embodiments, lower arm fins 120*b* are about 10-100 millimeters tall. In a preferred embodiment, lower arm fins 120*b* are about 60 millimeters tall.

Also, as shown in FIGS. 1 and 2, a fin 120*d* is located laterally on each shin and a fin 120*c* is located laterally on each thigh of body 160. The lateral thigh fins 120*c* preferably extend from the pelvis region of the surfer to the top of the knee. In some embodiments, the lateral thigh fins 120*c* are about 10-250 millimeters wide at the base and taper up to about a 1-40 millimeter wide rounded point at the top or edge. Preferably, the lateral thigh fins 120*c* are centered at the mid-portion of the thigh, front to back. In a preferred embodiment, the lateral thigh fins 120*c* are about 75 millimeters wide at the base and taper up to about a 15 millimeter wide rounded point at the top or edge. In some embodiments, lateral thigh fins 120*c* are about 10-150 millimeters tall. In a preferred embodiment, lateral thigh fins 120*c* are about 60 millimeters tall.

The lateral shin fins 120*d* preferably extend from the lower aspect of the tibial plateau (e.g., shin) of the surfer to the ankle. In some embodiments, the lateral shin fins 120*d* are about 10-150 millimeters wide at the base and taper up to about a 1-40 millimeter wide rounded point at the top or edge. Preferably, the lateral shin fins 120*d* are centered at the mid-portion of the shin, front to back. In a preferred embodiment, the lateral shin fins 120*d* are about 50 millimeters wide at the base and taper up to about a 15 millimeter wide rounded point at the top or edge. In some embodiments, lateral shin fins 120*d* are about 10-250 millimeters tall. In a preferred embodiment, lateral shin fins 120*d* are about 85 millimeters tall. While not wishing to be bound by any particular theory, it is believed that these lateral shin fins 120*d* aid in propulsion through the water, thereby reducing or eliminating the need for the surfer to wear fins on his feet.

In some embodiments, a fin 120*f* is located centrally on each shin and a fin 120*e* is located centrally on each thigh of body 160. In some embodiments, the central thigh fins 120*e* are about 5-120 millimeters wide at the base and taper up to about a 1-30 millimeter wide rounded point at the top or edge. Preferably, the central thigh fins 120*e* are centered at the mid-portion of the thigh, side to side. In a preferred embodiment, the central thigh fins 120*e* are about 60 millimeters wide at the base and taper up to about a 5 millimeter wide rounded point at the top or edge. In some embodiments, central thigh fins 120*e* are about 5-250 millimeters tall. In a preferred embodiment, central thigh fins 120*e* are about 100 millimeters tall.

In some embodiments, the central shin fins 120*f* are about 5-120 millimeters wide at the base and taper up to about a 1-30 millimeter wide rounded point at the top or edge. Preferably, the central shin fins 120*f* are centered at the mid-portion of the shin, side to side. In a preferred embodiment, the central shin fins 120*f* are about 50 millimeters wide at the base and taper up to about a 5 millimeter wide rounded point at the top or edge. In some embodiments, central shin fins

120*f* are about 5-250 millimeters tall. In a preferred embodiment, central shin fins 120*f* are about 110 millimeters tall.

Referring now to FIG. 3, in some embodiments, body surfing suit 100 also includes a plurality of dorsal fins 130. In some embodiments, body surfing suit 100 includes one or more dorsal fins. As shown, suit 100 includes two dorsal fins 130 located on the shoulder blades of the surfer. In some embodiments, the dorsal fins 130 are about 10-200 millimeters wide at the base and taper up to about a 1-40 millimeter wide rounded point at the top or edge. In a preferred embodiment, the dorsal fins 130 are about 40 millimeters wide at the base and taper up to about a 10-15 millimeter wide rounded point at the top or edge. In some embodiments, dorsal fins 130 are about 10-300 millimeters tall. In a preferred embodiment, dorsal fins 130 are about 50 millimeters tall.

In some embodiments, a fin 120*h* is located centrally on each calf and a fin 120*g* is located centrally on each hamstring of body 160. In some embodiments, the central hamstring fins 120*g* are about 5-120 millimeters wide at the base and taper up to about a 2-30 millimeter wide rounded point at the top or edge. Preferably, the central hamstring fins 120*g* are centered at the mid-portion of the hamstring, side to side. In a preferred embodiment, the central hamstring fins 120*g* are about 60 millimeters wide at the base and taper up to about a 5 millimeter wide rounded point at the top or edge. In some embodiments, central hamstring fins 120*g* are about 5-250 millimeters tall. In a preferred embodiment, central hamstring fins 120*g* are about 100 millimeters tall.

In some embodiments, the central calf fins 120*h* are about 5-120 millimeters wide at the base and taper up to about a 1-30 millimeter wide rounded point at the top or edge. Preferably, the central calf fins 120*h* are centered at the mid-portion of the calf, side to side. In a preferred embodiment, the central calf fins 120*h* are about 30 millimeters wide at the base and taper up to about a 5 millimeter wide rounded point at the top or edge. In some embodiments, central calf fins 120*h* are about 5-250 millimeters tall. In a preferred embodiment, central calf fins 120*h* are about 100 millimeters tall.

Also as shown in FIG. 3, body surfing suit 100 includes a plurality of fasteners 210 located on the posterior of the suit to keep body surfing suit 100 on the surfer. In one embodiment, fasteners 210 are zippers 215. A fastener 210 is preferably located on at least the torso of the body surfing suit 100, extending from the collar 102 to the rump. Additionally, a plurality of fasteners 210 may be located on each of the limbs, such as extending from mid-calf down to the ankle on the legs and extending from elbow down to the wrist on the arms. In cases where fins and fasteners are located on the same limbs, the fins are generally centered on the limb and the fasteners are generally off-center. When fastener 210 is a zipper 215, reinforcement areas or patches 220 may be desirable. These reinforcement areas 220 are usually located at the terminal end of the fastener 210. Also, reinforcement areas 220 may be fabricated from any suitable material known to make a zipper stronger and resist failure.

Still referring to FIG. 3, additional fasteners may be used to keep body surfing suit 100 on the surfer. For example, fasteners (not shown) may be included at the ends of the limbs of suit 100. On the legs, fasteners may be stirrups; stirrups would allow the suit 100 to be pulled down and maintained in a proper position.

On the arms, fasteners (not shown) may be finger rings. It is envisioned that as few as one or as many as five finger rings may be used in each fastener. Finger rings would aid in securing the suit 100 to the hand of the surfer, keeping the correct position of the suit in the lateral to medial directions.

Alternatively, in some embodiments, the hand of the surfer is encased by a glove (not shown) that is integral to suit 100. The glove may additionally be webbed, such that the hand of the surfer looks like a frog or duck foot when worn. These webbed gloves may be made of a thin spandex material so that it easily opens and collapses. In other embodiments, the webbed gloves will have cutoff finger tips to allow for size discrepancies.

Figure 4:
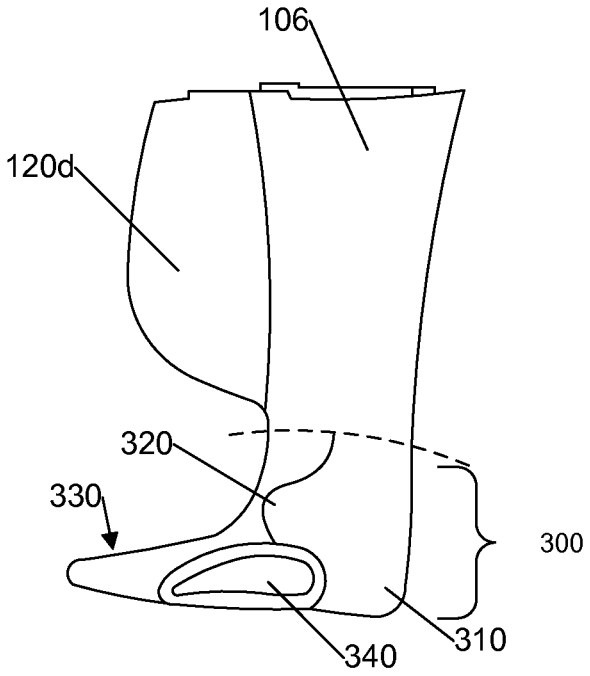
FIG. 4 is a front view of the booties of a body surfing suit accessory in accordance with an embodiment of the invention.

Referring now to FIG. 4, a body surfing accessory, booties 300 are shown. Booties 300 include a body portion 310 and a plurality of fins 320, 330. Body portion 310 preferably covers the ankle of the surfer and the foot of the surfer, with an opening 340 allowing the surfer's toes to be exposed. In a preferred embodiment, fin 330 represents a lateral foot fin (e.g., lateral to the foot) and fin 320 represents a top foot fin.

In some embodiments, the lateral foot fins 330 have a rounded front and taper backward in a curved arc. Lateral foot fins 330 preferably start at the base of the little toe and come forward slightly, then round at the front extending laterally about 10-300 millimeters. In a preferred embodiment, the lateral foot fins 330 extend laterally about 150 millimeters. Lateral foot fins 330 preferably are about 10-100 millimeters wide at the top of the foot tapering down to about 1-30 millimeters laterally. In a preferred embodiment, lateral foot fins 330 are about 40 millimeters wide at the top of the foot tapering down to about 15 millimeters laterally.

In some embodiments, booties 300 are fabricated from neoprene. As such, the booties 300 should easily slide onto the surfer's feet and complement suit 100. In a preferred embodiment, there is about a 35-millimeter neoprene section transition from the ankle to the foot which will stretch to allow for size discrepancies in wearers.

In some embodiments, all of the fins are preferably fabricated from a rigid material such as a glass fiber material or injection molded plastic material. In one embodiment, the fins are fabricated from high density thermoplastic polyurethane material. Alternatively, the fins may be fabricated from a more flexible and buoyant material such as floatation foam. Such floatation foams include, for example, polyvinyl chloride ("PVC") and polyurethane.

PVC is a polymer made by the catalytic polymerization of vinyl chloride. PVC also includes copolymers that contain at least 50% vinyl chloride. PVC molding compounds can be extruded, injection molded, compression molded, calendared, and blow molded to form a huge variety of products, either rigid or flexible, depending on the amount and types of plasticizers used.

Polyurethane foam is a two part material; polyurethane includes two different materials, polyols and isocyanates. These materials are available in liquid form and are impregnated with blowing agents in the raw materials. The materials when mixed, undergo a chemical reaction and the blowing agents are allowed to react and begin to foam, thereby creating polyurethane foam.

In some embodiments, the fins are fabricated using PVC an outer shell or form. These forms would then be able to be filled with a foam material such as polyurethane foam. Filling the form with foam would help in the reduction of unnecessary weight as well as aid in the buoyancy of the surfer in the water.

In some embodiments, the fins will be created out of a flat sheet material, which is then molded or formed. The fins will then be able to be sewn into body suit 100, in either the form of pockets or protrusions which stick through openings or slots cut into body suit 100. Alternately, or in addition, the fins may be attached to body suit 100 with an adhesive.

In some embodiments, suit 100 has a gradually tapering thickness (circumferentially) of buoyant foam material (e.g., buoyancy layer) which will begin with a thickness of 1-75 millimeters at the ankle region and increase up to 5-100 millimeters at the shoulder or sternum region. In some embodiments, there will be areas laterally as well as on the abdominal region which will be fin-like. Preferably, all of these areas will smoothly contour and blend into the suit 100, making it as seamless as possible.

In some embodiments, the buoyancy layer is covered with a drag reducing layer. The drag reducing layer may be produced by dipping or spraying PVC onto the buoyancy layer.

Processing

In some embodiments, the processes which will be utilized and best fitted for this type of product are thermoforming and station filling. Thermoforming starts when a sheet of extruded plastic material of specified thickness goes into a heater or heating area. Hot plates, arranged about 6 inches away from both the top and bottom of the sheet, heat the plastic to make it soft. After the plastic is soft it is removed out of the heating area by an automated, timed carrier. Next, an aluminum mold with the profile of the product desired rises up from underneath the sheet. The mold is raised to where the sheet is actually touching the outermost edge of the mold. Next, vacuum pressure is applied through many tiny holes in the mold. This vacuum pressure pulls the hot plastic sheet material down onto the contours of the mold to form the shape of the part. The hot plastic is left on the mold to cool. Some molds have water channels running through them to help cool the part faster. After cooling, air is blow up through the small vacuum holes to release the plastic part off of the mold. Since the part was first molded out of a sheet of plastic, more than likely the part will have to be trimmed.

This trimming process can be done in several different ways. The molds which would be created for this type of setting would be a family mold which would allow for several parts or forms to be created in a single cycle. The mold would be a family mold which contains several parts which when a single sheet of plastic is heated and formed around the tool would create several usable parts out of one cycle of the machine. This thermoforming process would be the desired process to create the forms or parts which are to be either sewn into or inserted into the wetsuit which will later be filled with a urethane style foam.

The second step in the creation of the suit would be to fill the PVC forms with a foam to help reduce the weight of the suit as well as help enhance the buoyancy of the suit. Any material has the capabilities of being created into a foam. Foam is made by mixing a number of chemicals and adding a "gassing agent" that makes bubbles that make the plastic cellular. The most commonly used foam is urethane foam. This type of foam is man-made and is capable of being created in a wide range of densities. This filling process would be done by an automated system which allows for the resin and the catalyst to be injected into a mold, or in this case the PVC form, in the correct amounts. This type of mixing is known as impingement. Impingement is simply defined as the mixing of the molecules via air born injecting of both the resin and catalyst. For example, a reaction injection molding (RIM) machine could be used for the impingement process.

In RIM, once the material is in the mold, the blowing agents begin to react and cause a foaming procedure to occur. This in turn creates the foam material as desired. Once the tack time, or the time for a specific material to lose the tackiness to touch feeling, the part will be able to be removed from the mold and allowed to further complete the curing process. Those of ordinary skill in the art will realize that the process described herein for processing the present suit is for exemplary purposes only. Any process capable of producing the present suit may be used.

Benefits realized from a body surfing suit made in accordance with the present invention include the following:

(1) Typically, when body-surfing without any suit at all, the surfer needs mobility and freedom of movement before and during the moment of catching a wave. Once the wave is caught, the surfer uses his body muscles to make himself rigid. These same principles need to be followed when designing a suit, and the suit and must allow full flexibility and freedom of movement. The present suit has been designed in that way; in all anatomic areas of movement (arms, legs, waist, trunk, etc) the material has been contoured, tapered, feathered and reduced to allow for complete freedom of movement.

(2) The present suit may have smooth 3-D contours which conform to the human anatomy, allowing bending, yet enhancing it with fin-like projections (e.g., similar to the dorsal fin on a marine animal), which provides stability as well as buoyancy.

(3) The present suit may have bilateral fin-like rails that start up near the shoulder region and proceed downward and laterally end at the base of the ribcage. These fins provide stability (to prevent yaw and roll), buoyancy and make the human body more streamlined in the water.

(4) The present suit may have a central chest fin or keel which aids in stability similar to that on a surfboard.

(5) The present suit may have buoyant material enveloped around the entire upper body. In some cases, the buoyant material envelopes the suit circumferentially, like a sea mammal.

(6) The present suit may have upper and lower lateral leg fins, as well as foot fins. In some cases, the leg fins are positioned in the lateral thigh and lateral calf regions, providing stability and more lateral surface area for propulsion when the legs are kicked, increasing the volume of water displaced with each kicking stroke (kind of like swim fins but out to the side of the leg). In some cases, the lateral fins on the feet provide greater surface area for propulsion with each kicking stroke. The lateral positioning of these foot fins allows the surfer to be able to walk without tripping due to the lateral position of the fin. Another feature of the foot fins is that they have small anterior fins/projections (on top of the foot) which act as keel-like stabilizers for directional control similar to a rudder on a boat.

(7) The present suit may have no edges and be smooth in all transition areas to reduce drag. For example, the present suit may have all of the edges (edge detail) where fins attach as smooth and feathered down exactly to the contour of the body so the edges disappear into the suit. As is easily appreciated, it is desirable to reduce drag to the lowest possible tolerance for optimal performance.

(8) The present suit may compliment and enhance the human anatomy for optimal streamlined performance in the water with unimpeded mobility. For example, it may be designed to enhance the thrust and water displacement during the kicking/swimming stroke to maximize propulsion. It may be super slick with seamless (e.g., as seamless as possible) transitions to reduce drag to the bare minimum. The present suit may take a clumsy land animal (human) with all of it's inherent anatomic deficiencies for locomotion in the water, augment it's anatomy without restricting movement, and turn it into a slick marine mammal for catching and riding waves better.

(9) The present suit may have buoyancy up as far forward toward the head as possible, with a decreasing gradient of buoyancy the farther toward the feet you go (buoyancy highest at head and lowest at the feet). Thus, the present suit may put the bulk of buoyant material up near the shoulders or sternum (head region) to limit/reduce the chance of plowing.

The above description of disclosed embodiments is provided to enable any person skilled in the art to make or use the invention. Various modifications to the embodiments will be readily apparent to those skilled in the art; the generic principals defined herein can be applied to other embodiments without departing from spirit or scope of the invention. For example, in some embodiments body surfing suit 100 is a short suit, meaning that legs 106 end above the surfer's knees. In such an embodiment, there may be only one set of fins 120 located on the legs 106 of suit 100. Thus, the invention is not intended to be limited to the embodiments shown herein but is to be accorded the widest scope consistent with the principals and novel features disclosed herein.

What is claimed is:

1. A body surfing apparatus comprising:

a wave surfing body suit having a torso and legs;

a plurality of chest fins located on the torso adjacent to a collar and extending to a bottom of a ribcage to provide directional stability during wave surfing, wherein each chest fin in the plurality of chest fins is individually attached with the body suit; and a lateral shin fin located laterally on a lower portion of each of the legs.

2. The apparatus of claim 1, wherein the body suit is fabricated from a material selected from: neoprene, spandex, nylon, ethylene-vinyl acetate (EVA), polyvinyl chloride (PVC), and polyurethane.

3. The apparatus of claim 1, wherein the chest fins comprise two lateral fins located on the torso adjacent to the collar which extend to the bottom of the ribcage at a curved angle.

4. The apparatus of claim 3, wherein the chest fins further comprise a center fin adjacent to the collar, disposed between the two lateral fins located on the torso, and extending to the bottom of the ribcage in a straight line.

5. The apparatus of claim 1, further comprising a lateral thigh fin located on an upper portion of each of the legs.

6. The apparatus of claim 5, wherein the lateral thigh fin is about 10-250 millimeters wide at the base, tapering up to about a 1-40 millimeter wide rounded point, and about 10-150 millimeters tall.

7. The apparatus of claim 5, wherein the lateral thigh fin is about 75 millimeters wide at the base, tapering up to about a 15 millimeter wide rounded point, and about 60 millimeters tall.

8. The apparatus of claim 1, further comprising a central shin fin located on the lower portion of each of the legs and generally perpendicular to the lateral shin fin.

9. The apparatus of claim 8, wherein the central shin fin is about 10-150 millimeters wide at the base, tapering up to about a 1-40 millimeter wide rounded point, and about 10-250 millimeters tall.

10. The apparatus of claim 8, wherein the central shin fin is about 50 millimeters wide at the base, tapering up to about a 15 millimeter wide rounded point, and about 85 millimeters tall.

11. The apparatus of claim 1, the body suit further comprising arms, wherein each arm includes one or more fins located on the arm.

12. The apparatus of claim 1, the body suit further comprising two dorsal fins located on respective shoulder blades of the torso.

13. The apparatus of claim 1, wherein the fins and suit are further covered with a drag reducing layer.

14. The apparatus of claim 1, wherein each of the fins has a wider base, adjacent to the suit and a narrower, tapered edge.

15. The apparatus of claim 1, wherein the torso has two sleeves each sleeve having two fins one on the lateral side of the upper arm and one on the lateral side of the lower arm.

16. The apparatus of claim 1, which includes foot accessories with a body portion covering the ankle and foot leaving an opening for the toes, and a plurality of fins including at least one lateral fin for directional control and top foot fin.

17. The apparatus of claim 1, which includes 13 total fins with these fins being two upper arm fins, two lower arm fins, two back fins, one center chest fin, one left lateral chest fin, one right lateral chest fin, two upper lateral leg fins, two lower lateral leg fins.

18. A body surfing apparatus comprising:

a wave-surfing body suit having a torso, arms and legs;

a plurality of chest fins located on the torso adjacent to a collar and extending to a bottom of a ribcage to provide directional stability during wave surfing, wherein each chest fin in the plurality of chest fins is individually attached with the body suit; and a lateral shin fin located laterally on a shin portion of each of the legs;

one or more fins located laterally on the arms;

and wherein the fins are attached to the body suit via adhesive or mechanical means, and each of the fins tapers up to a rounded point at the top.

19. The apparatus of claim 18, wherein the suit has a buoyancy gradient that is greatest at the shoulder and tapers down toward the ankle.

20. The apparatus of claim 18, wherein the chest fins located on the torso comprise two lateral fins which extend along the torso at a curved angle and one central fin disposed between the two lateral fins which extends along the torso in a straight line.

21. The apparatus of claim 20, wherein the central fin is about 2-150 millimeters wide at the base, tapering up to about a 1-40 millimeter wide rounded point, and about 10-150 millimeters tall.

22. The apparatus of claim 20, wherein the central fin is about 45 millimeters wide at the base, tapering up to about a 15 millimeter wide rounded point, and about 40 millimeters tall.

23. The apparatus of claim 20, wherein the two lateral fins and central fins adjacent to the collar extend to a bottom of a ribcage.

24. The apparatus of claim 18, wherein the body suit has a minimum thickness of 1 millimeter.

25. The apparatus of claim 18, wherein the suit is fabricated from neoprene.

26. The apparatus of claim 18, wherein the fins are fabricated from a material selected from: plastic, fiberglass, ethylene-vinyl acetate (EVA), polyvinyl chloride (PVC), IXL foam, fiberclad, phuzion, high density polyethylene (HDPE), polystyrene, and polyethylene.

27. The apparatus of claim 18, wherein the suit and fins are further covered with a drag reducing layer.

28. The apparatus of claim 27, wherein the drag reducing layer is polyvinyl chloride (PVC).

29. The apparatus of claim 18, further comprising a plurality of foot accessories, the foot accessories covering a portion of the foot and including one or more fins.

30. The apparatus of claim 29, wherein the one or more fins are lateral to the foot.

* * * * *